US007017667B2

(12) United States Patent
Hall et al.

(10) Patent No.: US 7,017,667 B2
(45) Date of Patent: Mar. 28, 2006

(54) DRILL STRING TRANSMISSION LINE

(75) Inventors: David R. Hall, Provo, UT (US); H. Tracy Hall, Jr., Provo, UT (US); David S. Pixton, Lehi, UT (US); Kline Bradford, Orem, UT (US); Joe Fox, Spanish Fork, UT (US)

(73) Assignee: IntelliServ, Inc., Provo, UT (US)

( * ) Notice: Subject to any disclaimer, the term of this patent is extended or adjusted under 35 U.S.C. 154(b) by 216 days.

(21) Appl. No.: 10/605,863

(22) Filed: Oct. 31, 2003

(65) Prior Publication Data

US 2005/0092499 A1 May 5, 2005

(51) Int. Cl.
*E21B 17/00* (2006.01)

(52) U.S. Cl. ..... 166/380; 166/65.1; 175/320

(58) Field of Classification Search ..... 166/65.1, 166/380; 175/320
See application file for complete search history.

(56) References Cited

U.S. PATENT DOCUMENTS

| | | | |
|---|---|---|---|
| 749,633 | A | 1/1904 | Seeley |
| 2,178,931 | A | 11/1939 | Crites et al. |
| 2,197,392 | A | 4/1940 | Hawthorn |
| 2,249,769 | A | 7/1941 | Leonardon |
| 2,301,783 | A | 11/1942 | Lee |
| 2,354,887 | A | 8/1944 | Silverman et al. |
| 2,379,800 | A | 7/1945 | Hare |
| 2,414,719 | A | 1/1947 | Cloud |
| 2,531,120 | A | 11/1950 | Feaster |
| 2,633,414 | A | 3/1953 | Boivinet |
| 2,659,773 | A | 11/1953 | Barney |
| 2,662,123 | A | 12/1953 | Koenig, Jr. |
| 2,748,358 | A | 5/1956 | Johnston |
| 2,974,303 | A | 3/1961 | Dixon |
| 2,982,360 | A | 5/1961 | Morton et al. |
| 3,079,549 | A | 2/1963 | Martin |
| 3,090,031 | A | 5/1963 | Lord |
| 3,170,137 | A | 2/1965 | Brandt |
| 3,186,222 | A | 6/1965 | Martin |
| 3,194,886 | A | 7/1965 | Mason |
| 3,209,323 | A | 9/1965 | Grossman, Jr. |
| 3,227,973 | A | 1/1966 | Gray |
| 3,253,245 | A | 5/1966 | Brandt |
| 3,518,608 | A | 6/1970 | Papadopoulos |
| 3,696,332 | A | 10/1972 | Dickson, Jr. et al. |
| 3,793,632 | A | 2/1974 | Still |
| 3,807,502 | A | 4/1974 | Heilhecker et al. |
| 3,879,097 | A | 4/1975 | Oertle |

(Continued)

FOREIGN PATENT DOCUMENTS

| | | | |
|---|---|---|---|
| EP | 0399987 | A1 | 11/1990 |

(Continued)

*Primary Examiner*—William Neuder
(74) *Attorney, Agent, or Firm*—Jeffery E. Daly; Tyson J. Wilde

(57) ABSTRACT

A transmission line assembly for transmitting information along a downhole tool comprising a pin end, a box end, and a central bore traveling between the pin end and the box end, is disclosed in one embodiment of the invention as including a protective conduit. A transmission line is routed through the protective conduit. The protective conduit is routed through the central bore and the ends of the protective conduit are routed through channels formed in the pin end and box end of the downhole tool. The protective conduit is elastically forced into a spiral or other non-linear path along the interior surface of the central bore by compressing the protective conduit to a length within the downhole tool shorter than the protective conduit.

18 Claims, 10 Drawing Sheets

U.S. PATENT DOCUMENTS 3,930,220 A 12/1975 Shawhan
3,957,118 A 5/1976 Barry et al.
3,989,330 A 11/1976 Cullen et al.
4,012,092 A 3/1977 Godbey
4,087,781 A 5/1978 Grossi et al.
4,095,865 A 6/1978 Denison et al.
4,121,193 A 10/1978 Denison
4,126,848 A 11/1978 Denison
4,215,426 A 7/1980 Klatt
4,220,381 A 9/1980 Van der Graaf
4,348,672 A 9/1982 Givler
4,445,734 A 5/1984 Cunningham
4,496,203 A 1/1985 Meadows
4,537,457 A 8/1985 Davis, Jr. et al.
4,578,675 A 3/1986 Macleod
4,605,268 A 8/1986 Meador
4,660,910 A 4/1987 Sharp et al.
4,683,944 A 8/1987 Curlett
4,698,631 A 10/1987 Kelly, Jr. et al.
4,722,402 A 2/1988 Weldon
4,785,247 A 11/1988 Meador et al.
4,788,544 A 11/1988 Howard
4,806,928 A 2/1989 Veneruso
4,884,071 A 11/1989 Howard
4,901,069 A 2/1990 Veneruso
4,914,433 A 4/1990 Galle
4,924,949 A 5/1990 Curlett
5,008,664 A 4/1991 More et al.
5,052,941 A 10/1991 Hernandez-Marti et al.
5,148,408 A 9/1992 Matthews
5,248,857 A 9/1993 Ollivier
5,278,550 A 1/1994 Rhein-Knudsen et al.
5,302,138 A 4/1994 Shields
5,311,661 A 5/1994 Zifferer
5,332,049 A 7/1994 Tew
5,334,801 A 8/1994 Mohn
5,371,496 A 12/1994 Tanamachi
5,454,605 A 10/1995 Mott
5,455,573 A 10/1995 Delatorre
5,505,502 A 4/1996 Smith et al.
5,517,843 A 5/1996 Winship
5,521,592 A 5/1996 Veneruso
5,568,448 A 10/1996 Tanigushi et al.
5,650,983 A 7/1997 Kondo et al.
5,691,712 A 11/1997 Meek et al.
5,743,301 A 4/1998 Winship
RE35,790 E 5/1998 Pustanyk et al.
5,810,401 A 9/1998 Mosing et al.
5,833,490 A 11/1998 Bouldin
5,853,199 A 12/1998 Wilson
5,856,710 A 1/1999 Baughman et al.
5,898,408 A 4/1999 Du
5,908,212 A 6/1999 Smith et al.
5,924,499 A 7/1999 Birchak et al.
5,942,990 A 8/1999 Smith et al.
5,955,966 A 9/1999 Jeffryes et al.
5,959,547 A 9/1999 Tubel et al.
5,971,072 A 10/1999 Huber et al.
6,030,004 A 2/2000 Schnock et al.
6,041,872 A 3/2000 Holcomb
6,045,165 A 4/2000 Sugino et al.
6,046,685 A 4/2000 Tubel
6,057,784 A 5/2000 Schaaf et al.
6,104,707 A 8/2000 Abraham
6,108,268 A 8/2000 Moss
6,123,561 A 9/2000 Turner et al.
6,141,763 A 10/2000 Smith et al.
6,173,334 B1 1/2001 Matsuzaki et al.
6,177,882 B1 1/2001 Ringgenberg et al.
6,188,223 B1 2/2001 van Steenwyk et al.
6,196,335 B1 3/2001 Rodney
6,209,632 B1 4/2001 Holbert et al.
6,223,826 B1 5/2001 Chau et al.
6,367,565 B1 4/2002 Hall
6,392,317 B1 5/2002 Hall et al.
6,405,795 B1 6/2002 Holbert et al.
6,641,434 B1 11/2003 Boyle et al.
6,655,464 B1 12/2003 Chau et al.
6,670,880 B1 12/2003 Hall et al.
2002/0135179 A1 9/2002 Boyle et al.
2002/0193004 A1 12/2002 Boyle et al.
2003/0070842 A1 4/2003 Bailey et al.
2003/0213598 A1 11/2003 Hughes
2004/0244964 A1* 12/2004 Hall et al. ..... 166/65.1
2005/0045339 A1* 3/2005 Hall et al. ..... 166/380
2005/0067159 A1* 3/2005 Hall et al. ..... 166/65.1

FOREIGN PATENT DOCUMENTS

WO WO8801096 2/1988
WO WO9014497 11/1990

* cited by examiner

DRILL STRING TRANSMISSION LINE

FEDERAL RESEARCH STATEMENT

This invention was made with government support under Contract No. DE-FC26-01NT41229 awarded by the U.S. Department of Energy. The government has certain rights in the invention.

BACKGROUND OF INVENTION

1. Field of the Invention

This invention relates to oil and gas drilling, and more particularly to apparatus and methods for reliably transmitting information along downhole drilling strings.

2. Background

In the downhole drilling industry, MWD and LWD tools are used to take measurements and gather information concerning downhole geological formations, status of downhole tools, and other conditions located downhole. Such data is useful to drill operators, geologists, engineers, and other personnel located at the surface. This data may be used to adjust drilling parameters, such as drilling direction, penetration speed, and the like, to effectively tap into an oil, gas, or other mineral bearing reservoir. Data may be gathered at various points along the drill string, such as from a bottom hole assembly or from sensors distributed along the drill string.

Nevertheless, data gathering and analysis represent only certain aspects of the overall process. Once gathered, apparatus and methods are needed to rapidly and reliably transmit the data to the earth's surface. Traditionally, technologies such as mud pulse telemetry have been used to transmit data to the surface. However, most traditional methods are limited to very slow data rates and are inadequate for transmitting large quantities of data at high speeds.

In order to overcome these limitations, various efforts have been made to transmit data along electrical and other types of cable integrated directly into drill string components, such as sections of drill pipe. In such systems, electrical contacts or other transmission elements are used to transmit data across tool joints or connection points in the drill string. Nevertheless, many of these efforts have been largely abandoned or frustrated due to unreliability and complexity.

For example, one challenge is effectively integrating a transmission line into a downhole tool, such as a section of tool. Due to the inherent nature of drilling, most downhole tools have an elongated cylindrical shape defining a central bore. The wall thickness surrounding the central bore is typically designed in accordance with weight, strength, and other constraints needed to operate in a downhole environment. In some cases, the wall thickness may not be sufficient to allow for direct integration of a transmission line into the wall without significantly weakening the wall. Thus, in certain instances, the transmission line may be routed through the internal bore of the downhole tool.

Nevertheless, routing the transmission line through the internal bore may create interference between the transmission line and drilling fluids, cements, wireline tools, or other substances or objects passing through the central bore. Moreover, in directional drilling applications, drill tools may bend slightly as a drill string deviates from a straight path. In these circumstances, the transmission line may actually deviate away from the internal surface of the central bore, thereby worsening the obstruction within the internal bore of the downhole tool. The operation of drilling fluids, cement, wireline tools, or other components may be adversely affected by interference with the transmission line or, in other instances, the transmission line itself may be damaged.

Thus, what are needed are apparatus and methods to route a transmission line though the central bore of a downhole tool, without interfering with drilling fluids, cement, wireline tools, or other components that may be present in the central bore.

What are further needed are apparatus and methods to keep a transmission line firmly pressed against the inside surface of the central bore even when the downhole tool bends or deviates from a linear path.

What are further needed are apparatus and methods to protect a transmission line from components or substances located or traveling through the central bore of a downhole tool.

SUMMARY OF INVENTION

In view of the foregoing, it is a primary object of the present invention to provide apparatus and methods for routing a transmission line though the central bore of a downhole tool, without interfering with drilling fluids, cement, wireline tools, or other components or substances present in the central bore. It is a further object of the invention to provide apparatus and methods to keep a transmission line firmly positioned against the inside surface of the central bore even when the downhole tool bends or deviates from a linear path. It is yet a further object of the invention to provide apparatus and methods to protect a transmission line from components or substances passing through the central bore of a downhole tool.

Consistent with the foregoing objects, and in accordance with the invention as embodied and broadly described herein, a transmission line assembly for transmitting information along a downhole tool comprising a pin end, a box end, and a central bore traveling between the pin end and the box end, is disclosed in one embodiment of the invention as including a protective conduit. A transmission line is routed through the protective conduit. The protective conduit is routed through the central bore and the ends of the protective conduit are routed through channels formed in the pin end and box end of the downhole tool. The protective conduit is elastically forced into a spiral or other non-linear path along the interior surface of the central bore by compressing the protective conduit to fit within a length of the downhole tool shorter than the protective conduit.

In selected embodiments, the protective conduit is narrowed to provide improved contact between the protective conduit and the transmission line. In certain embodiments, this narrowing provides additional stiffness to the protective conduit, thereby keeping the conduit more firmly pressed against the internal surface of the central bore. In selected embodiments, the narrowing makes the conduit less subject to deformation in the presence of cement, wireline or logging tools, drilling fluids, or other components or substances in the central bore.

In certain embodiments, the protective conduit is configured to stay pressed against the inside surface of the central bore even when the downhole tool bends in directional drilling applications. The transmission line may be a coaxial cable, conductive wires, optical fibers, waveguides, or like transmission media. In selected embodiments, the ends of the protective conduit are fixed at the pin end and box end of the downhole tool to retain the protective conduit.

In another aspect of the present invention, a method for routing a transmission line assembly through a drill tool having a pin end, a box end, and a central bore traveling between the pin end and the box end, includes providing a protective conduit and routing a transmission line through the protective conduit. The method further includes routing the protective conduit through the central bore, and routing the ends of the protective conduit through channels formed in the pin end and box end of the downhole tool. The method further includes compelling the protective conduit to a spiral or non-linear path along the interior surface of the central bore by constraining the protective conduit to fit within a length of the drill tool shorter than the protective conduit.

In selected embodiments, the method includes narrowing the protective conduit to provide improved contact between the protective conduit and the transmission line. This narrowing may provide additional stiffness to the protective conduit, thereby making the protective conduit less subject to deformation in the presence of downhole cement, wireline or logging tools, drilling fluids, or other downhole tools or substances. The added stiffness may also be effective to more firmly urge the protective conduit against the interior surface of the central bore.

In selected embodiments, the spiral or non-linear path the conduit takes through the central bore may be effective to maintain contact between the protective conduit and the internal bore when the downhole tool bends in directional drilling applications. In certain embodiments, the transmission line may be coaxial cable, conductive wire, optical fiber, waveguides, or like transmission media. In other embodiments, a method in accordance with the invention includes fixing the ends of the protective conduit proximate the pin end and the box end of the downhole tool, respectively.

In another aspect of the present invention, a method for forming a transmission line assembly for routing through a drill tool having a pin end, a box end, and a central bore traveling between the pin end and the box end, includes providing a protective conduit and routing a transmission line through the protective conduit. The method further includes narrowing the protective conduit to provide improved contact between the protective conduit and the transmission line, and routing the protective conduit through the drill tool such that it spirals or takes a non-linear path along the interior surface of the central bore. The ends of the protective conduit are routed through channels formed in the pin end and box end of the downhole tool.

BRIEF DESCRIPTION OF DRAWINGS

The foregoing and other features of the present invention will become more fully apparent from the following description, taken in conjunction with the accompanying drawings. Understanding that these drawings depict only typical embodiments in accordance with the invention and are, therefore, not to be considered limiting of its scope, the invention will be described with additional specificity and detail through use of the accompanying drawings.

DETAILED DESCRIPTION

It will be readily understood that the components of the present invention, as generally described and illustrated in the Figures herein, could be arranged and designed in a wide variety of different configurations. Thus, the following more detailed description of embodiments of apparatus and methods of the present invention, as represented in the Figures, is not intended to limit the scope of the invention, as claimed, but is merely representative of various selected embodiments of the invention.

The illustrated embodiments of the invention will be best understood by reference to the drawings, wherein like parts are designated by like numerals throughout. Those of ordinary skill in the art will, of course, appreciate that various modifications to the apparatus and methods described herein may easily be made without departing from the essential characteristics of the invention, as described in connection with the Figures. Thus, the following description of the Figures is intended only by way of example, and simply illustrates certain selected embodiments consistent with the invention as claimed herein.

Figure 10:
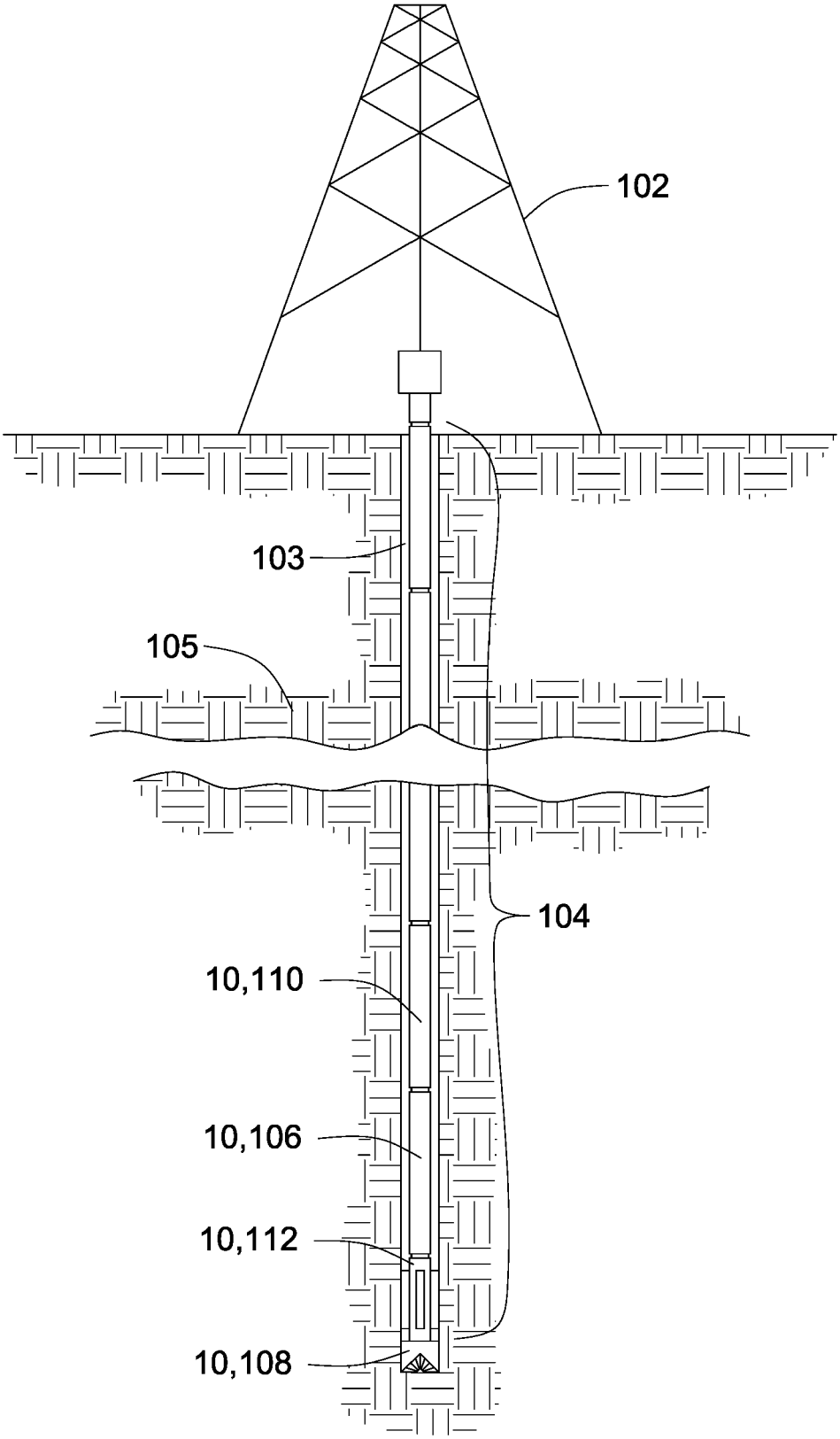

FIG. 10 is a cross section view of a drill rig 102 drilling a borehole 103 into the earth 105 using downhole tools (collectively indicated by numeral 10) of the present invention. The collection of downhole tools 10 form at least a portion of a drill string 104. In operation, a drilling fluid is typically supplied under pressure at the drill rig 102 through the drill string 104. The drill string 104 is typically rotated by the drill rig 102 to turn a drill bit 108 which is loaded against the earth 105 to form the borehole 103. The pressurized drilling fluid is circulated through the drill bit 108 to provide a flushing action to carry the drilled earth cuttings to the surface. Rotation of the drill bit may alternately be provided by other downhole tools such as drill motors, or drill turbines (not shown) located adjacent to the drill bit 108. Other downhole tools include drill pipe 110 and downhole instrumentation such as logging while drilling tools 106, and sensor packages, (not shown). Other useful downhole tools include stabilizers 112, hole openers, drill collars, heavyweight drill pipe, sub-assemblies, under-reamers, rotary steerable systems, drilling jars, and drilling shock absorbers which are all well known in the drilling industry.

Figure 1:
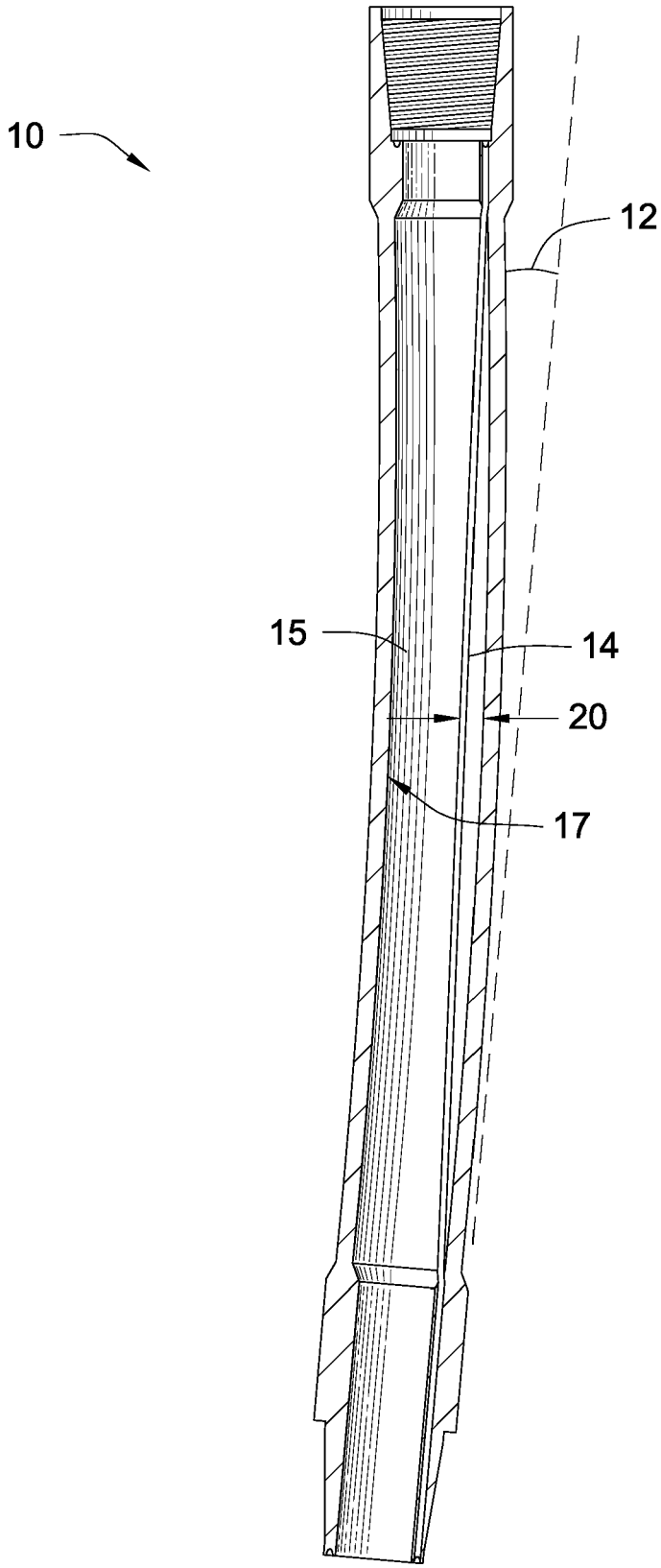
FIG. 1 is a cross-sectional view illustrating one embodiment of separation that may occur between a substantially linear transmission line and the central bore of a downhole drill tool when the drill tool is curved or bent as is customary in directional drilling applications.

Referring now to FIG. 1, a drill tool 10, such as a section of drill pipe 10, 110, may take on the illustrated shape. Due to the linear nature of downhole drilling, a drill string 104 may comprise multiple tool sections 10 having various functions. In an effort to tap into gas, oil, or other mineral deposits, a drill string may be guided or deviate from a linear path. Thus, in selected directional drilling applications, tools 10 may bend or curve to veer off in a desired direction. Since a drill string may consist of many hundreds of sections of drill pipe and other downhole tools, the cumulative bend or curve in each tool may enable a drill string to drill horizontally in some cases.

As was previously mentioned, in order to transmit data up and down the drill string 104, a transmission line 14 may be integrated into a drill tool 10. If the transmission line 14 is routed straight along the central bore 15 of the drill tool 10, the transmission line 14 may separate or detach from the inside surface of the central bore 15 when the drill tool 10 bends or curves. This may be undesirable since the transmission line 14 may obstruct or interfere with fluids, wireline tools, concrete, or other objects or substances traveling through the central bore. In fact, in some cases, when a drill tool 10, such as a section of drill pipe 10, bends significantly, the transmission line 14 may actually come into contact with the opposite side 17 of the central bore 15. Thus, apparatus and methods are needed to route a transmission line 14 through the central bore 15 such that the transmission line 14 stays in relatively constant contact with the inside surface of the central bore 15.

Figure 2:
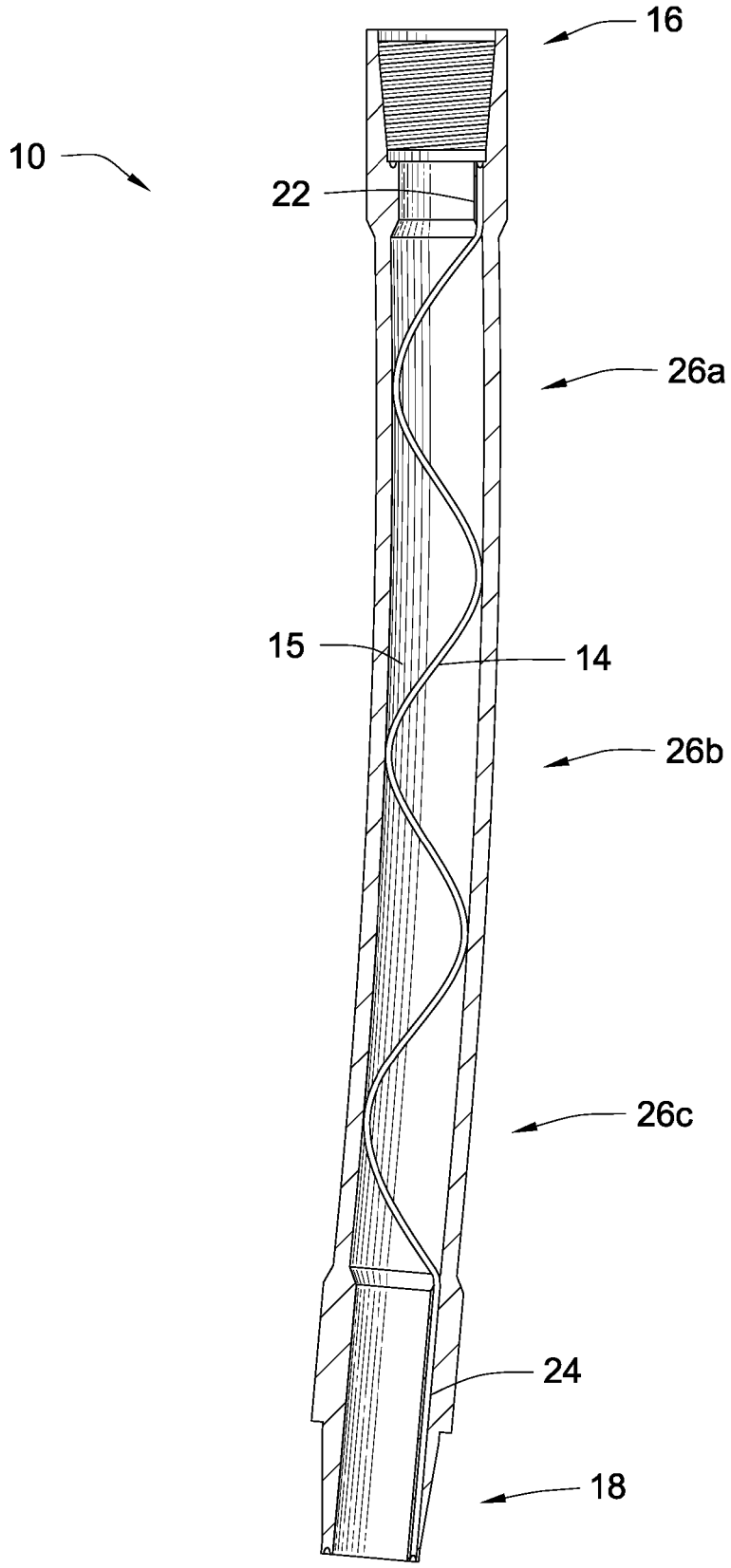
FIG. 2 is a cross-sectional view of a non-linear or spiraled transmission line integrated into a drill tool similar to that illustrated in FIG. 1, wherein the transmission line maintains substantial contact with the inside surface of the central bore of the drill tool.

Referring to FIG. 2, for example, in selected embodiments, a transmission line 14 in accordance with the present invention may be routed in a non-linear path along the inside surface of the central bore 15. In selected embodiments, the transmission line 14 may take a substantially spiral path around the inside surface of the central bore 15. This configuration may provide several advantages. For example, in situations where the drill tool 10 bends or curves, the transmission line 14 may stay in substantially continuous contact with the inside surface 15 of the drill tool 10 since the transmission line 14 may flex or bend with the drill tool 10. Moreover, the spiral-like shape of the transmission line 14 may provide a bias to urge the transmission line 14 against the inside surface of the central bore 15 as will be described in more detail hereinafter.

When in a spiral configuration, the transmission line 14 may have relatively few coils. For example, in selected embodiments, there may be between 3 and 5 coils 26*a–c*. Since drill tools 10, such as sections of drill pipe 10, may reach lengths of more than 30 feet, each coil 26 may span approximately 6 to 10 feet of the drill tool. Nevertheless, any number of coils 26 may be used as desired.

The transmission line 14 is not pre-formed into a spiral or other non-linear shape, but simply takes on a spiral shape because it is elastically forced or compelled to fit within the central bore 15 of the downhole tool 10. Thus, if the transmission line 14 were removed from the drill tool 10, the transmission line 14 may substantially revert to the shape it had before insertion into the downhole tool 10. The transmission 14 remains in the elastic mode and is not yielded. Thus, the transmission line 14 may be constructed of resilient materials capable of taking on a spiral or other non-linear shape. This resiliency assists in keeping the transmission line 14 pressed or biased against the inside surface of the central bore 15, as it is elastically loaded against the wall. Were the transmission line 14 pre-formed into a spiral, the yielding associated with forming the spiral not only significantly reduces the available loading against the wall, but also may change the electrical characteristics of the transmission line 14 or worse, damage it.

Another reason for not pre-forming the transmission line 14 into a spiral or other non-linear shape is that doing so may be difficult. As was previously described, in selected embodiments, the coils 26*a–c* may be spaced every 6 to 10 feet. This relatively "lazy" spacing of the coils 26 may be difficult to pre-form into a transmission line 14. As stated earlier, by not pre-forming the coils 26, the transmission line 14 may be urged with greater force against the inside diameter of the central bore 15 since the tendency of the transmission line 14 may be to uncoil itself.

As illustrated, the ends of the transmission line 14 may be routed through channels 22, 24 formed in the pin end 18 and box end 16 of a drill tool 10. The channels 22, 24 may keep the ends of the transmission line 14 rigidly fixed. This enables the coiled or spiral shape of the transmission line 14 to be maintained since, together with the central bore 15, the channels 22, 24 hold the transmission line 14 in its spiral or non-linear shape.

Figure 3:
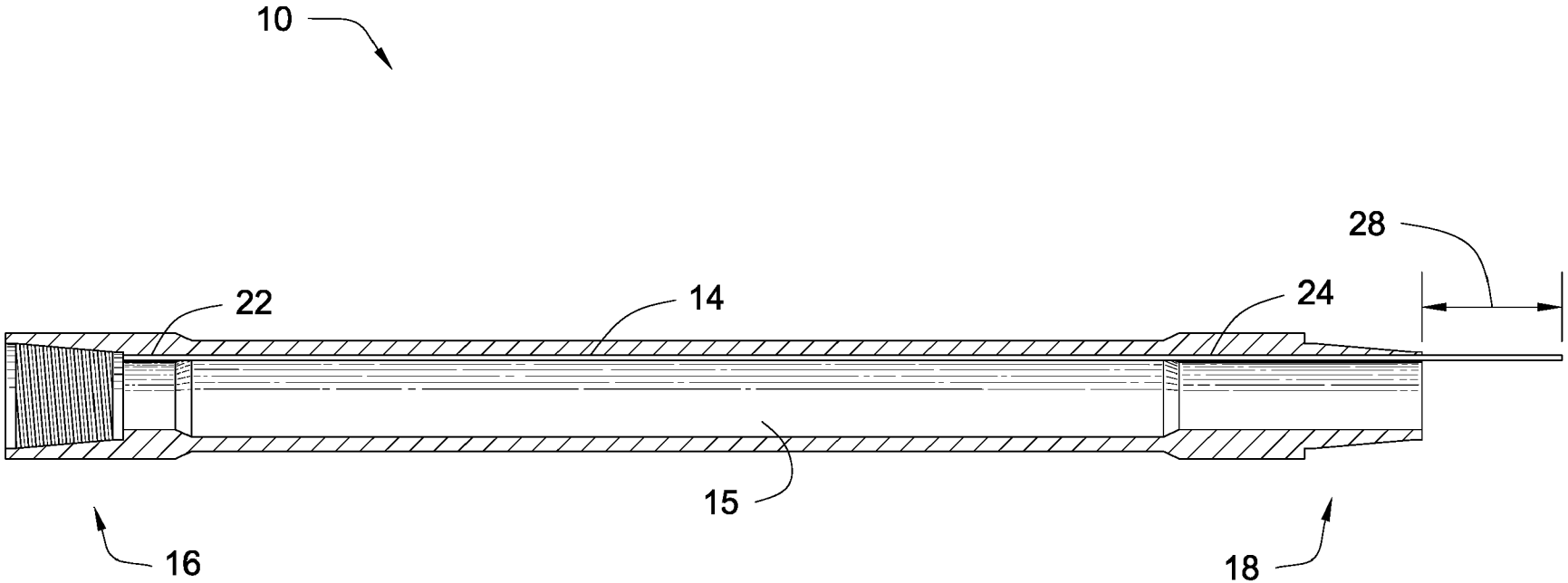
FIG. 3 is a cross-sectional view illustrating one embodiment of a linear transmission line initially inserted into the central bore of a downhole drill tool.

Referring to FIG. 3, in selected embodiments, a substantially linear transmission line 14 may be initially inserted through a first channel 22 in the box end 16 of the drill tool 10, through the central bore 15, and through a second channel 24 in the pin end 18. The transmission line 14 may be sized such that it extends from the channel 24 a specified length 28. This additional length 28 may disappear when coils 26 are introduced into the transmission line 14.

Figure 4:
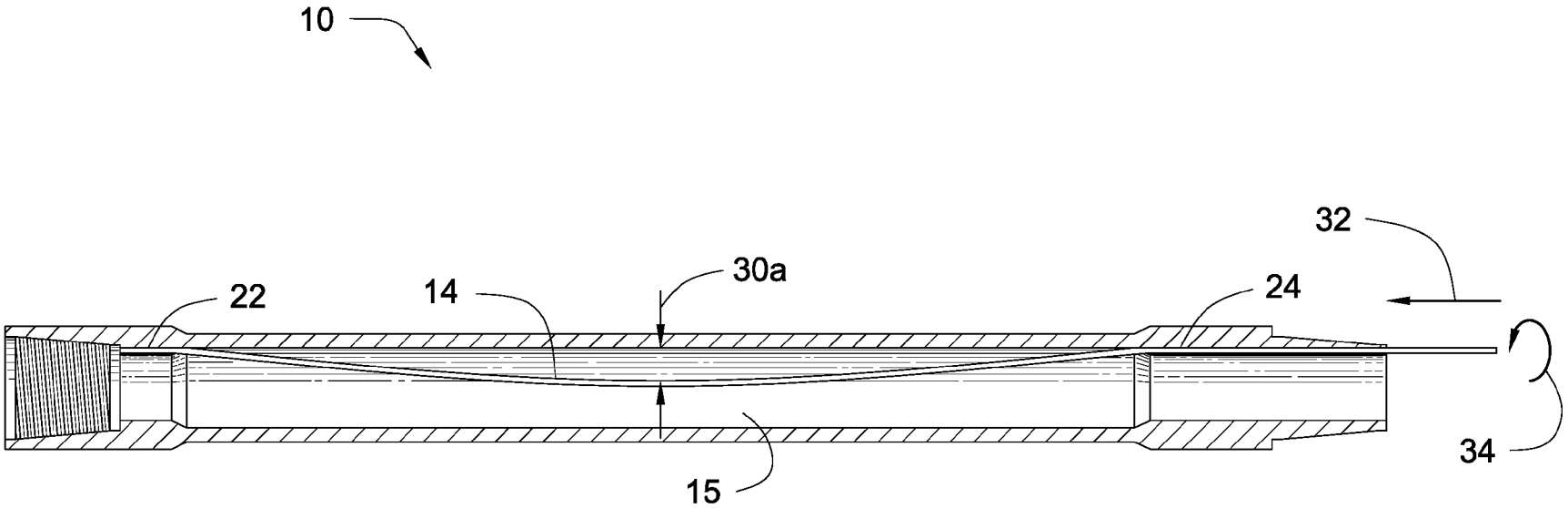
FIG. 4 is a cross-sectional view illustrating one embodiment of a linear transmission line beginning to buckle as it is elastically forced or urged into the downhole drill tool.

Referring to FIG. 4, for example, the surplus length 28 of the transmission line may be urged into the central bore 15 of the downhole tool 10. When this occurs, the transmission line 14 may begin to buckle and a gap 30*a*, or separation 30*a*, may open up between the transmission line 14 and the inside surface of the central bore 15. Optionally, a torque 34 or rotation 34 may also be applied to the transmission line 14 to help it form a spiral within the central bore 15.

Figure 5:
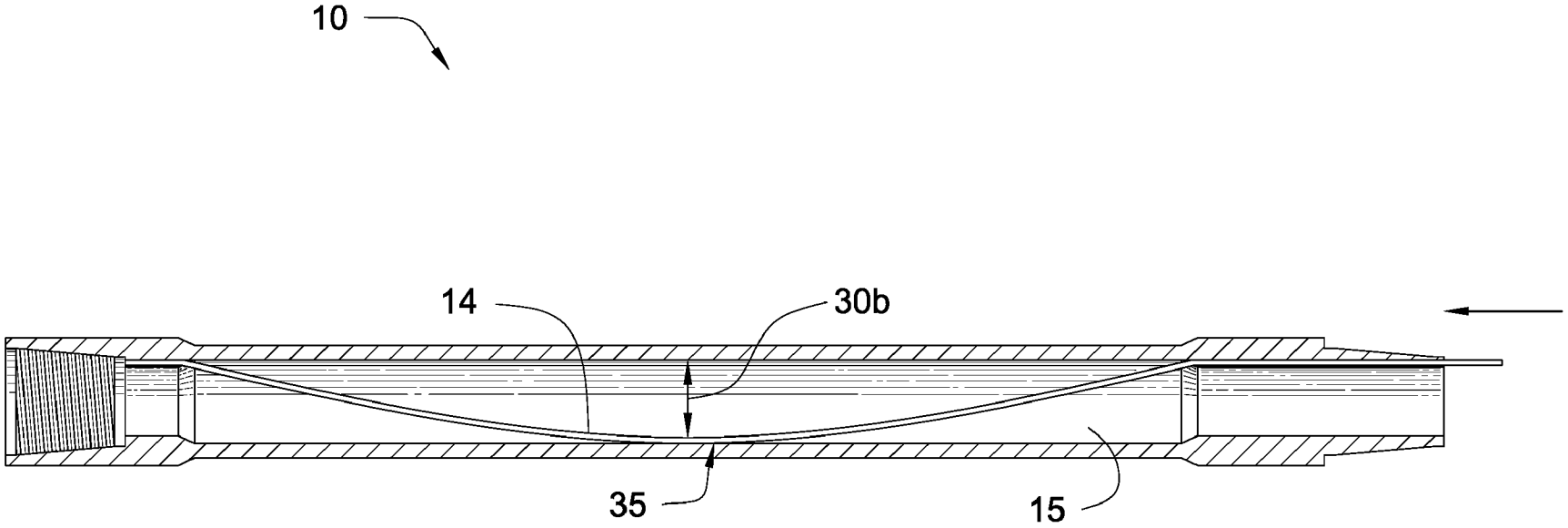
FIG. 5 is a cross-sectional view illustrating one embodiment of a linear transmission line further elastically forced or urged into the downhole drill tool such that the linear transmission line begins to coil or spiral within the central bore of the drill tool.

Referring to FIG. 5, as the transmission line 14 is further urged into the central bore 15, the transmission line 14 may contact the opposite side 35 of the central bore 15. Since the transmission line 14 may resist buckling further, the transmission line 14 may begin to form a spiral or other non-linear shape within the central bore 15.

Figure 6:
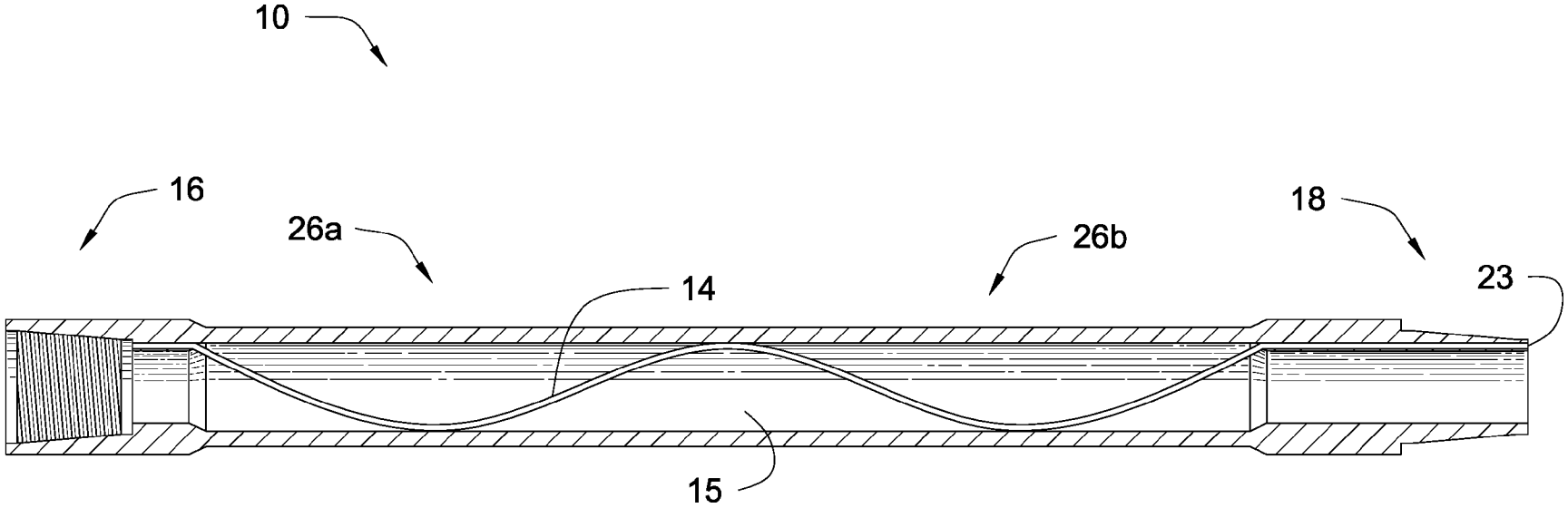
FIG. 6 is a cross-sectional view illustrating one embodiment of a linear transmission line further elastically forced or urged into the downhole drill tool such that the linear transmission line begins to form multiple coils or spirals.

Referring to FIG. 6, as the transmission line 14 is urged further into the central bore 15, the transmission line 14 may begin to form several coils 26*a*, 26*b* within the central bore 15. As was previously discussed, any desired number of coils 26 may be formed in the transmission line 14 according to the length of the transmission line 14 and the length of the drill tool 10. In certain embodiments, each coil 26 may require approximately 8 inches or so of additional length of transmission line 14. However, this may vary according to the number of coils 26, the inside diameter of the central bore 15, the length of each coil 26, as well as other factors.

Figure 7:
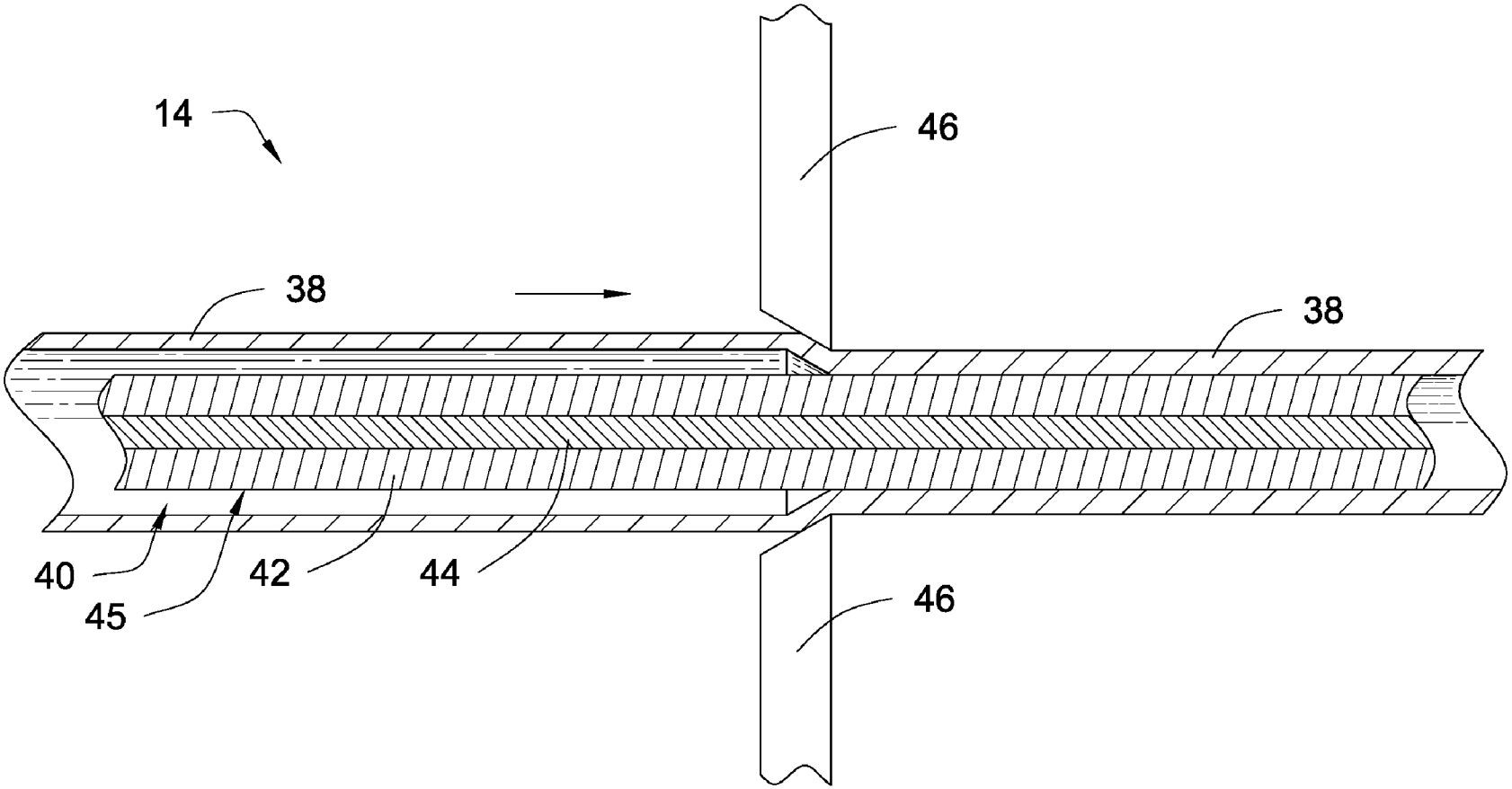
FIG. 7 is a cross-sectional view illustrating one embodiment of a conduit narrowed as it passes through a tool, such that the conduit forms a substantial bond or contact with a transmission cable.

Referring to FIG. 7, a transmission line 14 may comprise various components. For example, in certain embodiments, the transmission line 14 may include an outer protective conduit 38 and an inner transmission cable 40, such as a coaxial cable 40. In selected embodiments, a coaxial cable 40 may include a core conductor 44, a dielectric core 42, and a shield 45. In other embodiments, the transmission cable 40 may comprise one or several conductors, such as copper wires, optical fibers, waveguides, or the like. Any media capable of transmitting a desired signal may be used in accordance with the present invention. Likewise, the protective conduit 38 may be any suitable material, such as metal, certain types of plastics, fiber materials, and the like. In selected embodiments, the protective conduit 38 may be constructed of stainless steel.

In certain cases, a conduit 38 used to protect or cover a transmission cable 40 may have an inside diameter larger than the outside diameter of the transmission cable 40. Thus, in certain embodiments, it may be desirable to improve the bond between the conduit 38 and the cable 40. This may provide several advantages. For example, an improved bond may keep the transmission cable 14 from moving with respect to the conduit, thereby reducing wear or chafing that may occur between the two. An improved bond may also keep unwanted fluids or other substances from being introduced between the conduit 14 and the cable 40.

In selected embodiments, the diameter of the conduit may be reduced to more closely bond with or contact the cable 40. For example, the conduit 38 may be narrowed by passage through a tool 46. This narrowing process may actually thicken the walls of the conduit, thereby providing additional stiffness or resiliency to the conduit 38. This may be desirable because the added stiffness or resiliency may keep the conduit 38 more firmly pressed against the inside surface of the central bore 15. In selected embodiments, stainless steel may provide a suitable material for the conduit 38 since it is resistant to corrosion and wear, and is also sufficiently resilient. Nevertheless, other materials may also be used and provide similar qualities.

Figure 8:
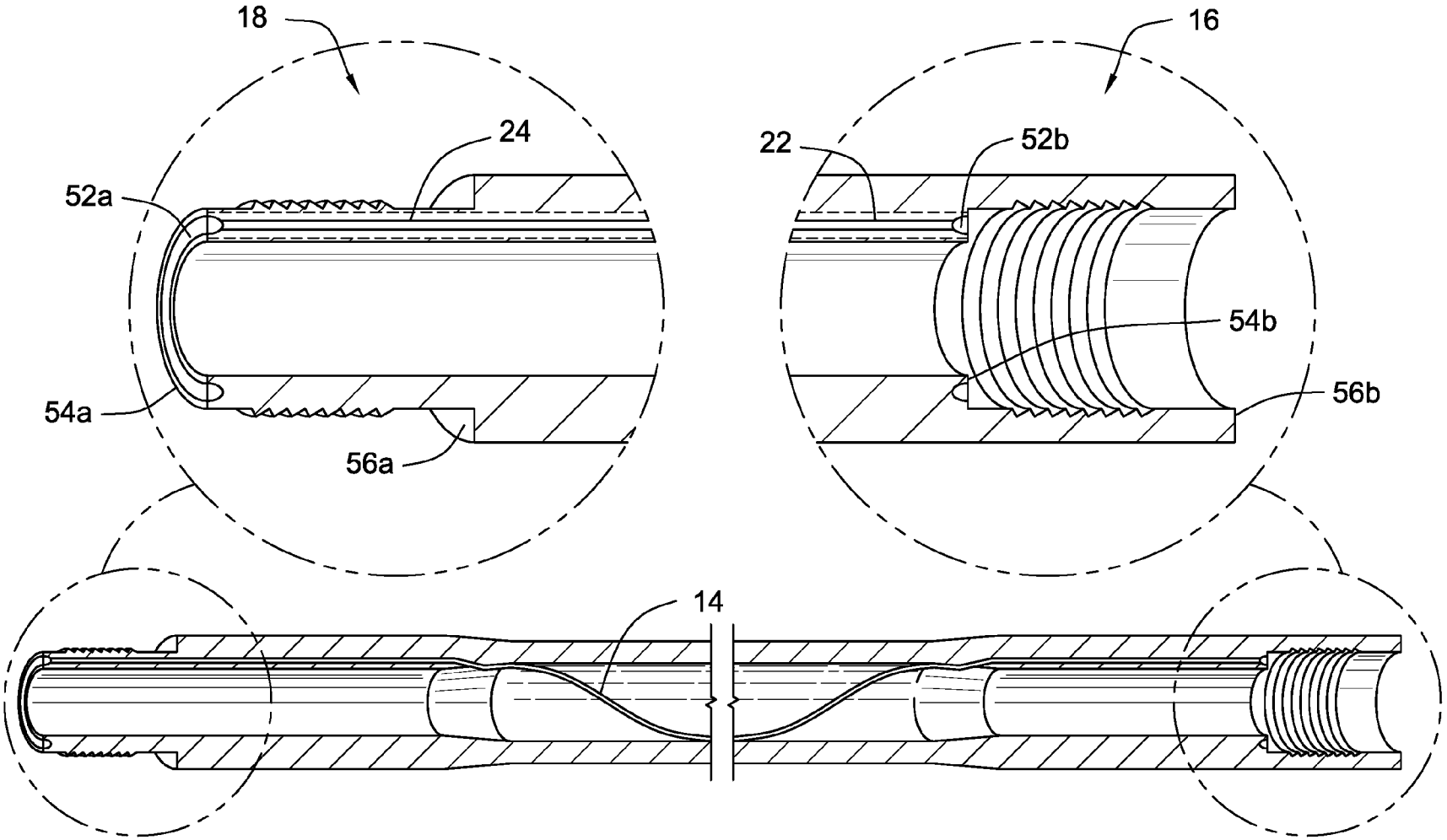
FIG. 8 is a perspective cross-sectional view illustrating one embodiment of a box end and pin end of a drill tool comprising an integrated transmission line.

Referring to FIG. 8, an enlarged cross-sectional view of the box end 16 and pin end 18 of a drill tool 10 in accordance with the present invention is illustrated. In certain embodiments, channels 22, 24 may be gun-drilled or otherwise formed in the box end 16 and pin end 18 of a drill tool 10. The channels 22, 24 may serve to fix the ends of the transmission line 14 and provide a path to connect the transmission line 14 to transmission elements 52*a*, 52*b* mounted in the box end 16 and pin end 18 of the drill tool 10. Channels 22, 24 may be provided in the box end 16 and pin end 18 because thicker walls are present in this area of the drill tool 10.

As was mentioned, the channels 22, 24 may provide a convenient location to fix the ends of the transmission line 14. For example, in selected embodiments, the conduit 38 may be flared (not shown) to keep the transmission line 14 fixed with respect to the channels 22, 24. In other embodiments, keys, wedges, or other components (not shown) may be inserted in the channel 22, 24 between the transmission line 14 and the channel 22, 24 to keep the transmission line 14 from moving with respect to the channel 22, 24. In reality, any other suitable method of fixing the transmission line 14 with respect to the channels 22, 24 may be used and is within the scope of the present invention.

As illustrated, transmission elements 52*a*, 52*b* may be installed in the box end 16 and pin end 18 of the drill tool 10, respectively. Recesses may be milled or otherwise formed in the box and pin end 16, 18 to accommodate the transmission elements 52*a*, 52*b*. In certain embodiments, the transmission elements 52*a*, 52*b* may be installed in the secondary shoulders 54*a*, 54*b*, rather than the primary shoulders 56*a*, 56*b*, since the secondary shoulders 54*a*, 54*b* may be more protected from external elements and may also be less subject to stress incident on the primary shoulders 56*a*, 56*b*.

Figure 9:
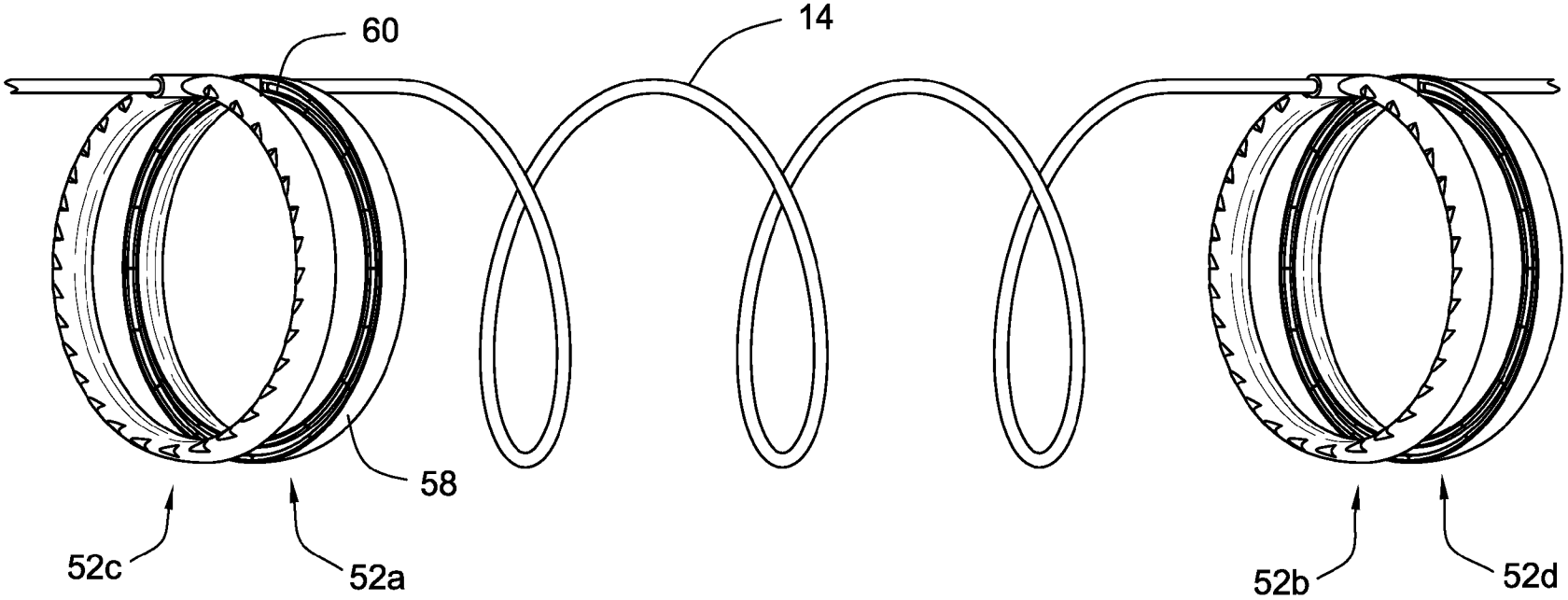
FIG. 9 is a perspective cross-sectional view illustrating one embodiment of a transmission line coupled to a pair of transmission elements for communicating across tool joints.

Referring to FIG. 9, the transmission elements 52*a*, 52*b* located in the box end 16 and pin end 18 may communicate with transmission elements 52*c*, 52*c* located in other connected downhole tools. The transmission elements 52*a*, 52*b* may be characterized by an annular shape mountable in recesses formed in the annular ends of a drill tool 10. The annular shape may provide consistent connectivity between downhole tools 10 since these downhole tools 10 may rotate with respect to one another as they are threaded together. In selected embodiments, the transmission elements 52 may include an outer housing 58 and an inner conductor 60 within the housing 58 and insulated therefrom.

In selected embodiments, the transmission elements 52 may communicate by direct electrical contact with one another. A conductor 60 of one transmission element 52 may contact a corresponding conductor 60 located in a corresponding transmission element 52. In other embodiments, the transmission elements 52 may communicate inductively. That is, the transmission elements 52 may convert electrical signals transmitted along the transmission line 14 to magnetic fields for transmission from one transmission element 52*a* to another 52*c*. This may be advantageous in cases where direct electrical contacts are unreliable.

The present invention may be embodied in other specific forms without departing from its essence or essential characteristics. The described embodiments are to be considered in all respects only as illustrative, and not restrictive. The scope of the invention is, therefore, indicated by the appended claims, rather than by the foregoing description. All changes within the meaning and range of equivalency of the claims are to be embraced within their scope.

The invention claimed is:

1. A transmission line assembly for transmitting information along a downhole tool, the downhole tool comprising a pin end, a box end, and a central bore traveling between the pin end and the box end, the transmission line assembly comprising:

a protective conduit;

a transmission line routed through the protective conduit;

the protective conduit being further routed through the central bore, the ends thereof being routed through channels formed in the pin end and box end; and the protective conduit being further elastically forced into a non-linear path through the central bore by elastically confining the protective conduit to a length within the central bore shorter than the protective conduit wherein the diameter of the protective conduit is narrowed to provide improved contact between the protective conduit and the transmission line.

2. The transmission line assembly of claim 1, wherein the non-linear path is substantially a spiral.

3. The transmission line assembly of claim 1, wherein the narrowed diameter of the protective conduit provides additional stiffness to the protective conduit.

4. The transmission line assembly of claim 3, wherein the stiffened protective conduit is less subject to deformation in the presence of at least one of downhole cement, other downhole tools, and drilling fluids.

5. The transmission line assembly of claim 1, wherein the protective conduit is urged against the interior surface of the central bore.

6. The transmission line assembly of claim 5, wherein the protective conduit is further configured to stay substantially pressed against the internal bore when the downhole tool bends.

7. The transmission line assembly of claim 1, wherein the transmission line is selected from the group consisting of coaxial cable, conductive wire, optical fiber, and waveguides.

8. The transmission line assembly of claim 1, wherein the ends of the protective conduit are fixed proximate the pin end and the box end of the downhole tool.

9. A method for routing a transmission line assembly through a drill tool having a pin end, a box end, and a central bore traveling between the pin end and the box end, the method comprising:

providing a protective conduit;

routing a transmission line through the protective conduit;

narrowing the diameter of the protective conduit to provide improved contact between the protective conduit and the transmission line;

routing the protective conduit through the central bore, the ends thereof being routed through channels formed in the pin end and box end; and forcing the protective conduit to take a non-linear path through the central bore by elastically forcing the protective conduit to fit within a length of the central bore shorter than the protective conduit.

10. The method of claim 9, wherein the non-linear path is substantially a spiral.

11. The method of claim 9, wherein narrowing the diameter provides additional stiffness to the protective conduit.

12. The method of claim 11, wherein the stiffened protective conduit is less subject to deformation in the presence of at least one of downhole cement, other downhole tools, and drilling fluids.

13. The method of claim 9, further comprising urging the protective conduit against the interior surface of the central bore.

14. The method of claim 9, further comprising maintaining contact between the protective conduit and the internal bore when the downhole tool bends.

15. The method of claim 9, further comprising selecting to transmission line from the group consisting of coaxial cable, conductive wire, optical fiber, and waveguides.

16. The method of claim 9, further comprising fixing the ends of the protective conduit proximate the pin end and the box end of the downhole tool, respectively.

17. A method for forming a transmission line assembly for routing through a drill tool living a pin end, a box end, and a central bore traveling between the pin end and the box end, the method comprising:

providing a protective conduit;

routing a transmission line through the protective conduit;

narrowing the diameter of the protective conduit to provide improved contact between the conduit and the transmission line; and routing the protective conduit through the drill tool such that it substantially spirals elastically around the interior surface of the central bore, the ends thereof being routed through channels formed in the pin end and box end.

18. The method of claim 17, wherein narrowing the diameter of the protective conduit provides additional stiffness to the protective conduit.

* * * * *